US006603406B2

(12) United States Patent
Jambhekar et al.

(10) Patent No.: US 6,603,406 B2
(45) Date of Patent: Aug. 5, 2003

(54) METHOD AND APPARATUS FOR DETECTING AND RESPONDING TO AN ABSENCE OF JOURNEY-RELATED INFORMATION

(75) Inventors: Shrirang Nilkanth Jambhekar, Palatine, IL (US); David Wheatley, N. Barrington, IL (US); William F. Zancho, Hawthorn Woods, IL (US); Leslie Gabor Seymour, Barrington, IL (US)

(73) Assignee: Motorola, Inc., Schaumburg, IL (US)

( * ) Notice: Subject to any disclaimer, the term of this patent is extended or adjusted under 35 U.S.C. 154(b) by 0 days.

(21) Appl. No.: 09/994,269

(22) Filed: Nov. 26, 2001

(65) Prior Publication Data

US 2003/0098800 A1 May 29, 2003

(51) Int. Cl.[7] ..... G08G 1/09
(52) U.S. Cl. ..... 340/905; 340/995.13; 455/99
(58) Field of Search ..... 340/905, 995, 340/988, 995.13; 701/117, 200, 208, 211; 455/425, 517, 99

(56) References Cited

U.S. PATENT DOCUMENTS

| | | | | | |
|---|---|---|---|---|---|
| 4,334,320 A | * | 6/1982 | Liman | ..... | 455/227 |
| 4,862,513 A | * | 8/1989 | Bragas | ..... | 455/226 |
| 5,131,020 A | * | 7/1992 | Liebesny et al. | ..... | 340/905 |
| 5,617,086 A | | 4/1997 | Klashinsky et al. | | |
| 5,940,769 A | * | 8/1999 | Nakajima et al. | ..... | 455/509 |

OTHER PUBLICATIONS

"*Driving the Info Highway*" by Steven Ashley; Scientific America, Oct. 2001, pp. 51–58.

* cited by examiner

*Primary Examiner*—Brent A. Swarthout
(74) *Attorney, Agent, or Firm*—Fitch, Even, Tabin & Flannery

(57) ABSTRACT

In a vehicle equipped with a dedicated short-range two-way communications system to acquire and otherwise participate in a roadway information service, method and apparatus are provided to detect (301) an absence of the availability of such a service and to respond by substituting (302) roadway information from other sources and to provide notice (303) to the driver regarding the absence of realtime service information and/or the present use of substituted roadway information.

40 Claims, 5 Drawing Sheets

Figure 1:
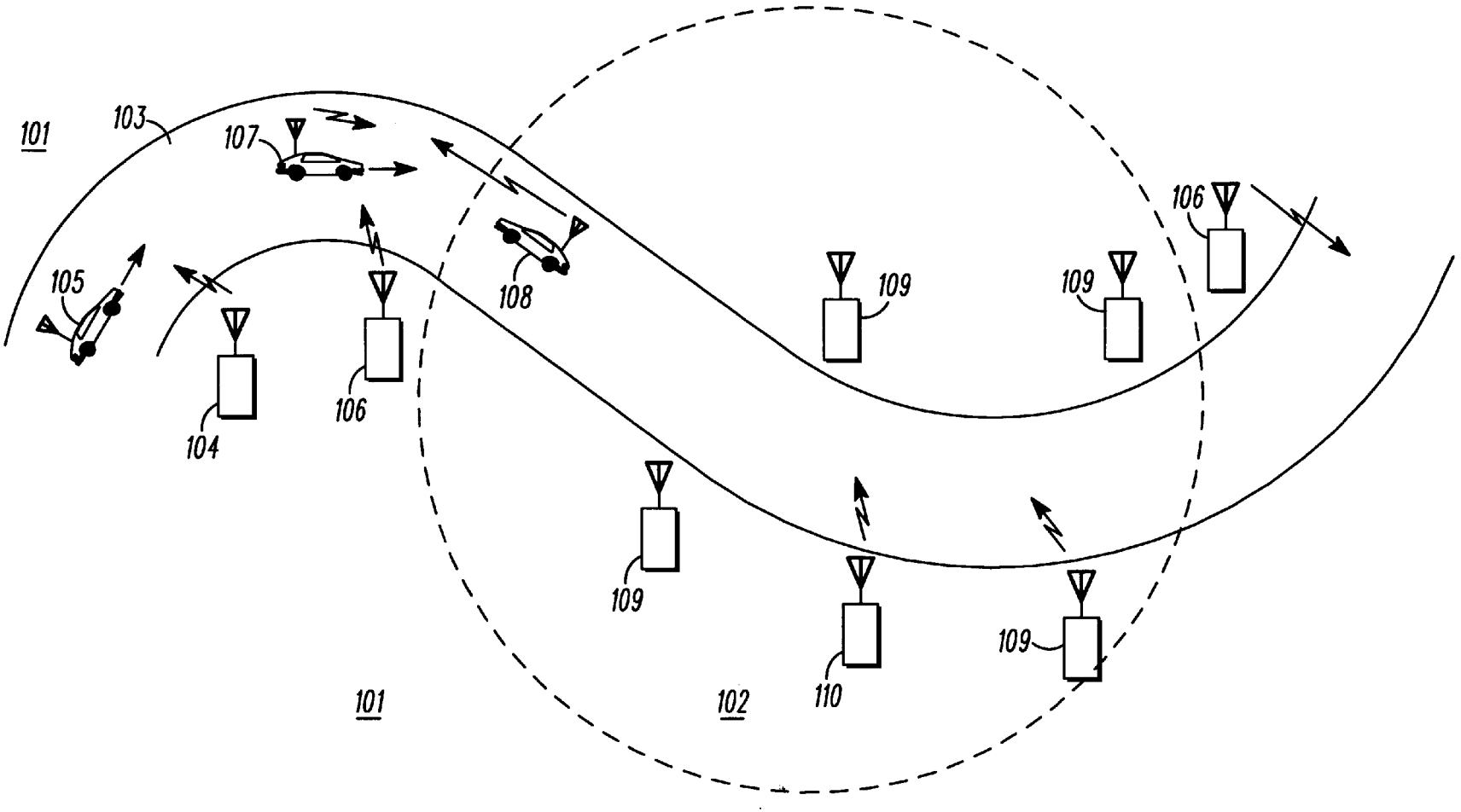

METHOD AND APPARATUS FOR DETECTING AND RESPONDING TO AN ABSENCE OF JOURNEY-RELATED INFORMATION

TECHNICAL FIELD

This invention relates generally to driver and vehicle journey facilitation systems and particularly to such systems as have a wireless communications facility.

BACKGROUND OF THE INVENTION

Wireless communications are known. Wireless systems making use of frequency reuse, such as cellular systems, are virtually ubiquitous and dispatch services are also well integrated and dispersed. Both are key components of modern infrastructure.

Now, at least one group seeks to define a new wireless communications service to specifically facilitate terrestrial-based vehicular journeys (particularly for automobiles and trucks). Presently known as dedicated short range communications (DSRC), the Federal Communications Commission in the United States has presently at least tentatively identified spectrum that can be used for such journey-related information. The American Society for Testing and Materials presently acts as a standards development group to define such a communications service to support provision of journey-related information to vehicular users. At present, the over-the-air interface has not been defined (though at least two wireless local area network systems—the I.E.E.E.#802.11A and Motorola's control channel based Freespace system—have been proposed and are being considered). This group has, however, made considerable progress towards defining the services that the service will support. In particular, such a journey-related information provision system should ultimately provide roadside information and corresponding vehicle-to-vehicle communications to support both public safety and private requirements (depending upon the application transmission range will likely vary from fifteen meters to three hundred meters).

As an example of public safety services, such a roadside information system can be expected to support:

- Traffic count (for example, determining the number of vehicles that traverse an intersection over a given period of time);
- Traffic movement information;
- Toll collection;
- In-vehicle signage (for example, presenting "stop" information within the cockpit of a vehicle as the vehicle approaches a stop sign);
- Road condition warnings;
- Intersection collision avoidance (including highway/rail intersections);
- Vehicle-to-vehicle information (for example, stopped vehicle or slowing vehicle information);
- Rollover warnings;
- Low bridge warnings;
- Boarder clearance facilitation;
- On-board safety data transfer;
- Driver's daily log;
- Vehicle safety inspection information; and
- Emergency vehicle traffic signal preemption.

Examples of private requirements include;

- Premises access control;
- Gasoline payment;
- Drive-through retail payment;
- Parking lot payments;
- Various vehicular related data transfers (for example, diagnostic data, repair service record data, vehicular computer program updates, map information, and user content such as music);
- Rental car processing;
- Fleet management;
- Locomotive fuel monitoring; and
- Locomotive data transfer.

As such communications systems that serve to support provision of journey-related information to a user (where the "user" may be a driver or passenger of a vehicle and/or the vehicle itself) are constructed and placed in service, coverage will likely not be universal. Certainly at the outset coverage cannot likely be complete. Consequently travelers will journey in and out of geographic zones that do not support the service. These zones may be small or large and these zones may represent temporary or ongoing conditions. As users come to rely upon such services for safety, convenience, comfort, and control, however, encountering such geographic zones during a journey may pose troubling and even dangerous circumstances for the user.

A need therefor exists for a way to detect the present and/or future likelihood that such services are not or will not be available within a particular geographic area.

A need therefor exists far away to alert a user when such services are not presently and/or imminently available to a given user.

A need therefor exists for a way to substitute, at least to some degree, for the services that are missing in such a geographic zone.

BRIEF DESCRIPTIONS OF THE DRAWINGS

Figure 2:
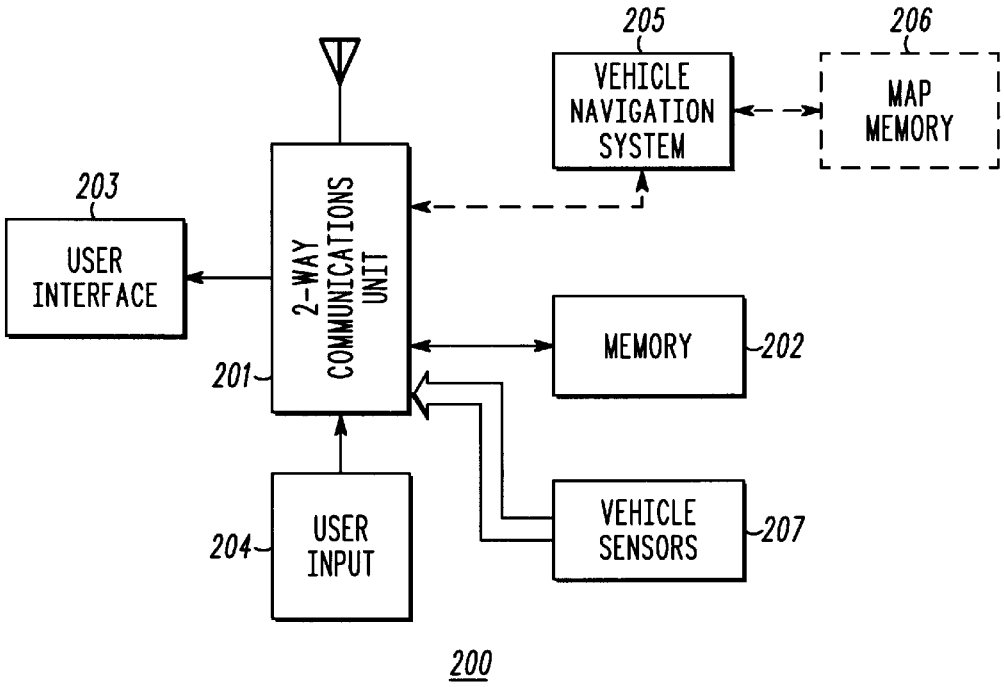
Figure 8:
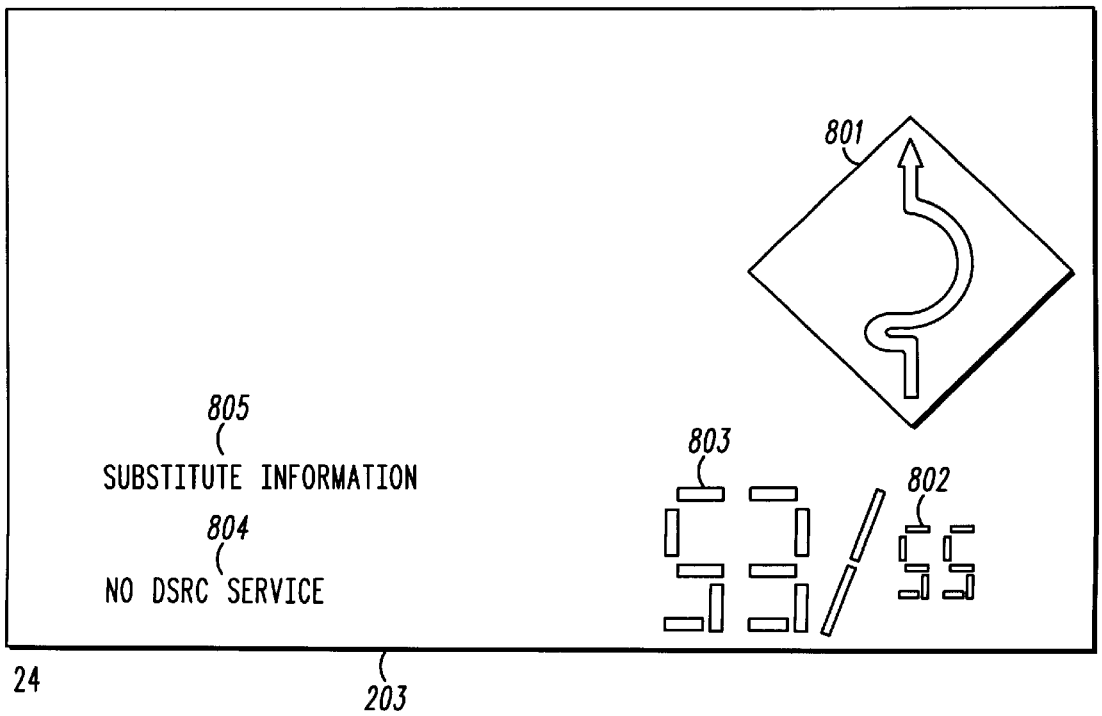
Figure 3:
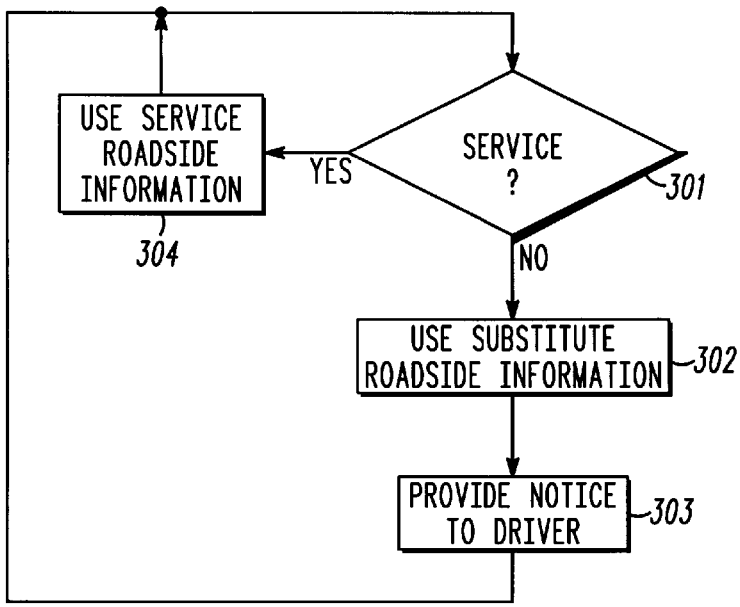
Figure 4:
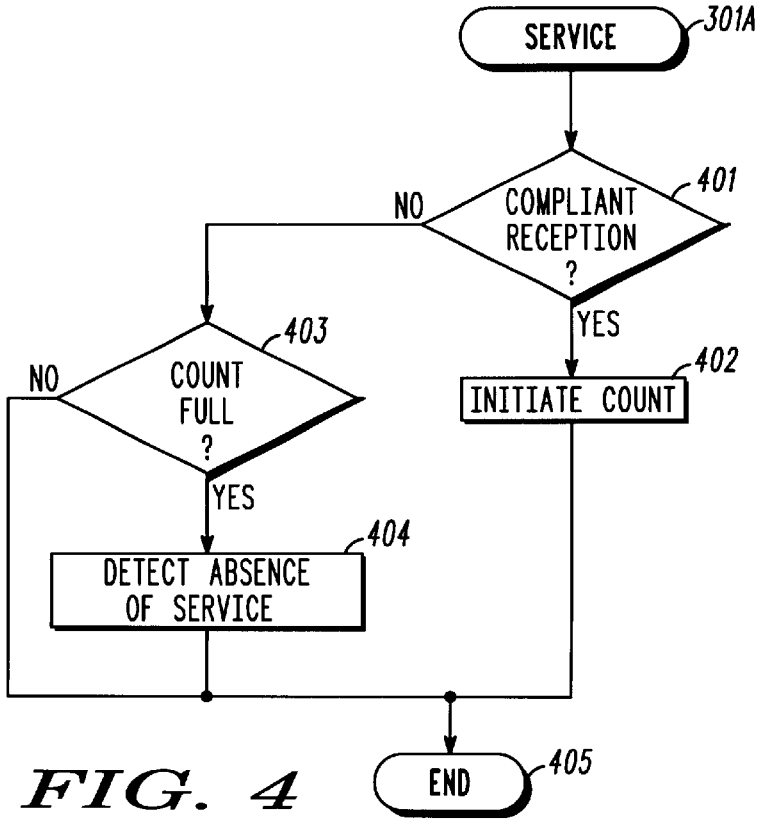
Figure 6:
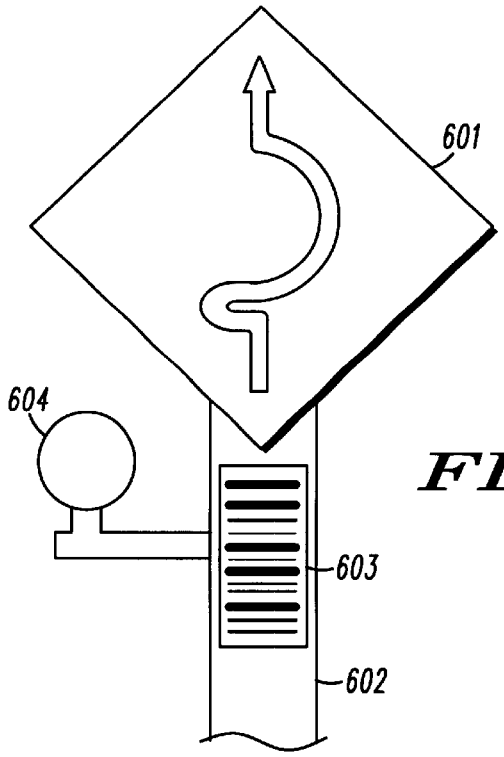
Figure 5:
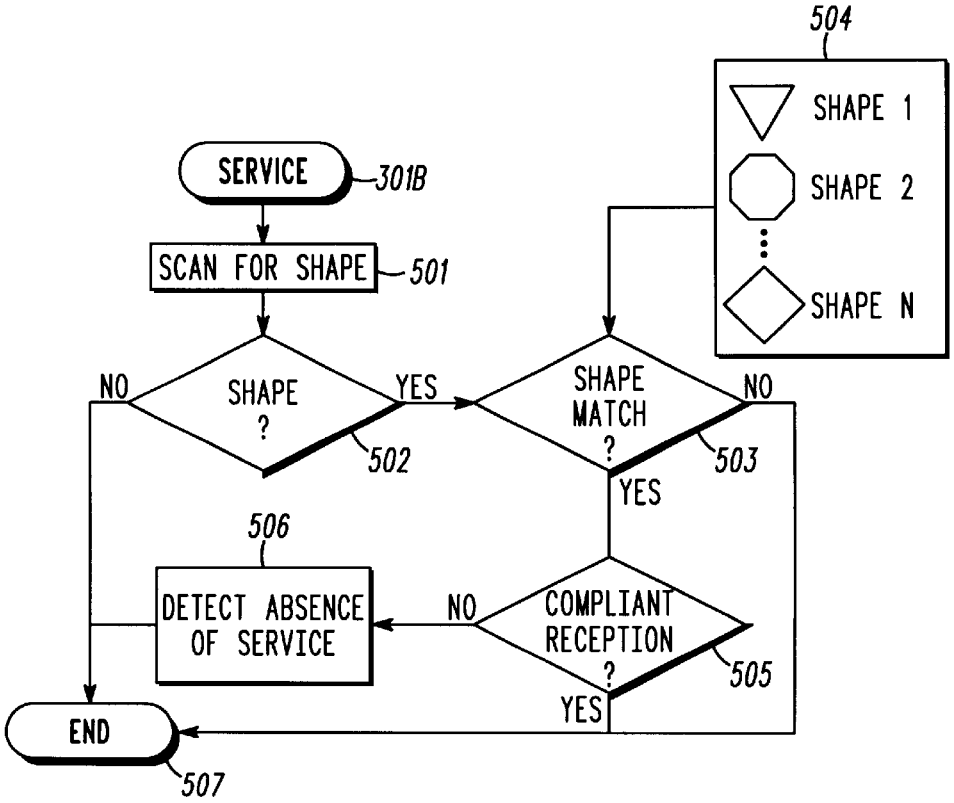
Figure 7:
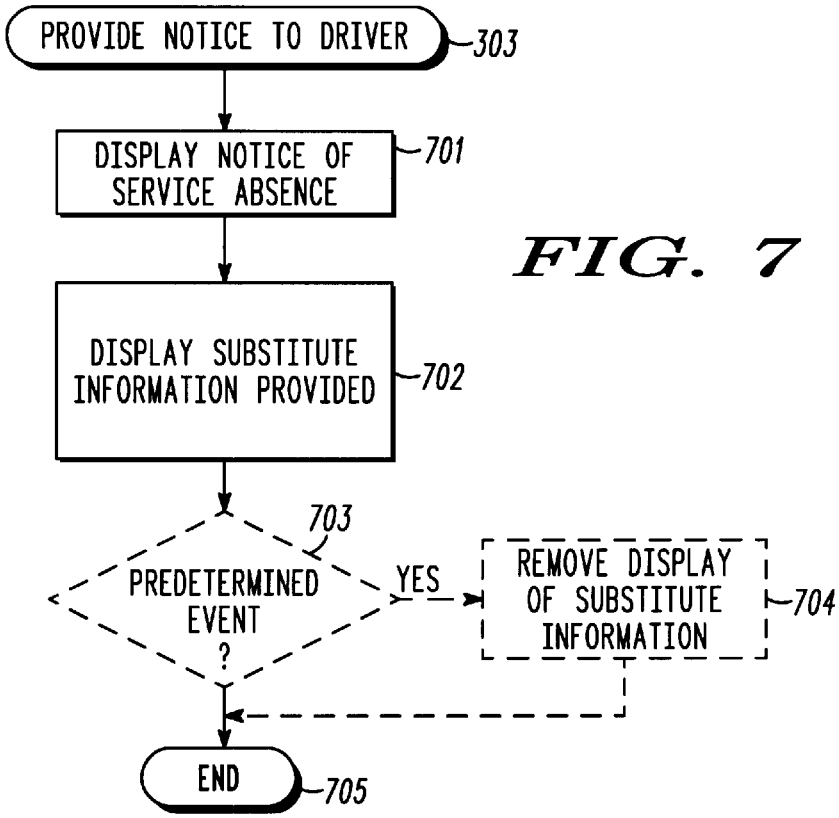
Figure 9:
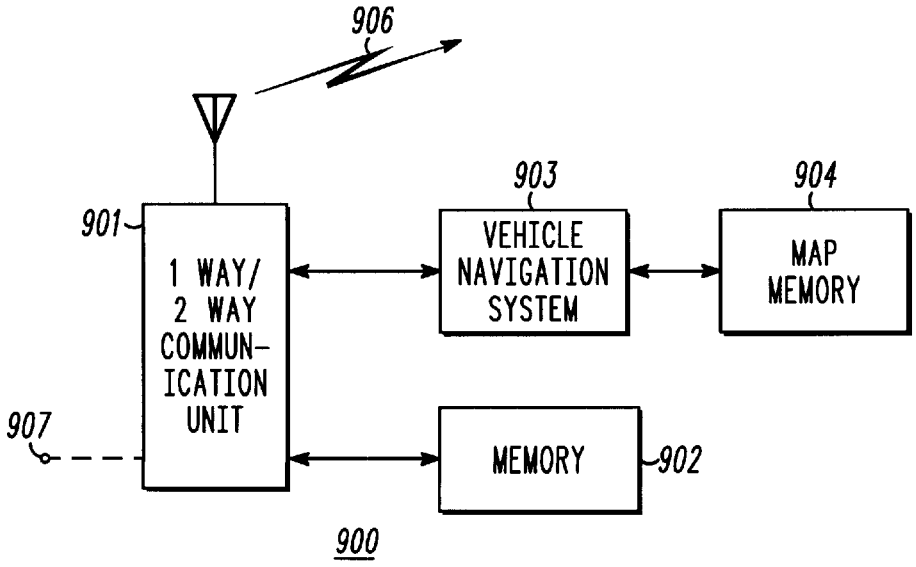

These needs and others are at least substantially met through provision of the invention and embodiments taught herein. These teachings are discernable upon making a thorough and complete review and study of the following detailed description, particularly when reviewed in conjunction with the drawings, wherein:

FIG. 1 comprises a diagram of a first geographic area and a second geographic area wherein a roadway passes through at least portions of both areas;

FIG. 2 comprises a block diagram depiction of a user platform;

FIG. 3 comprises a flow diagram of a general method comprising an embodiment of the invention;

FIG. 4 comprises a detailed flow diagram in accordance with one embodiment of the invention;

FIG. 5 comprises a detailed flow diagram in accordance with a different embodiment of the invention;

FIG. 6 comprises a front elevational view of a portion of a sign post configured in accordance with an embodiment of the invention;

FIG. 7 comprises a detailed flow diagram in accordance with an embodiment of the invention;

FIG. 8 comprises a front elevational view of a user interface configured in accordance with an embodiment of the invention; and FIG. 9 comprises a block diagram depiction of an optional supplemental vehicle-based platform.

DETAILED DESCRIPTION OF THE PREFERRED EMBODIMENTS

Pursuant to the following detailed description, a terrestrial vehicle, such as an automobile, truck, locomotive, or the like, has a two-way radio communication unit that transmits and receives radio frequency transmissions in a manner compliant with a roadway information service (such as, for example, DSRC services). This user platform, in accordance with the teachings herein, can detect an absence of such roadway information service transmissions. Upon detecting such an absence of transmissions, the user platform can begin using substitute roadway information and automatically provide notice to at least the driver of the vehicle regarding the absence of received transmissions and/or the automatic use of substitute roadway information.

So configured, the user platform can provide at least some journey-related information to the vehicle user in a manner that imitates, at least for some items of information, the same information delivery mechanism as is used for informing the user of realtime roadway information as received through the roadway information service when available. Furthermore, though substitute information may substitute for some or all of the missing roadway information, the user platform can also notify the user of the absence of roadway information service transmissions. Individually and collectively, such actions and information can contribute to safety, convenience, comfort, and efficiency of continuing and/or completing a present journey through a geographic area that does not support, for whatever reason, the roadway information service.

Referring now specifically to the figures, FIG. 1 illustrates a first geographic zone 101 that supports a specific roadway information service and a second geographic zone 102 that does not. A roadway 103 passes through both geographic zones 101 and 102. Therefore, for example, a vehicle 105 passing through the first geographic zone 101 will receive roadway information from transmitters 104 regarding various journey-related content. In the example given, this transmitter 104 can be transmitting information regarding an upcoming sharp turn, which specific journey-related information can be used by the user platform in the vehicle 105 to provide, for example, interior signage information regarding the upcoming sharp curve.

Conversely, the roadway 103 as it traverses the second geographic zone 102 does not benefit from such an infrastructure. This can occur because the roadway information service has not been extended into the second geographic zone 102. This can also happen because existing infrastructure for the first roadway information service in the second geographic zone 102 has been partially or wholly rendered inoperable. For example, a natural or man-made disaster may render at least some of the transmitters 109 in the second geographic zone 102 inoperable.

Other details depicted in FIG. 1 will be described below as relevant to a corresponding description or explanation of other apparatus or process.

Referring now to FIG. 2, a user platform 200 includes a two-way communications unit 201 that functions compatibly with at least the roadway information service (this two-way communications unit 201 can be made optionally compatible with other communications services as appropriate to a particular application). A memory 202 or couples to the two-way communications unit 201 to store, for example, information regarding the user and/or downloaded information regarding an anticipated journey as described below. A user interface 203 couples to the two-way communications unit 201 to facilitate the provision of roadway information to a user of the vehicle. This user interface can include a textual and/or graphic display in either an integrated or sectioned presentation format that can include, for example, in-dash displays and heads-up displays. The user interface 203 can also include other means of conveying information including, for example, transducers and the like to render certain information audible.

To the extent a vehicle has a vehicle navigation system 205 on-board (such as a global positioning system based navigation system and/or a dead reckoning navigation system) that vehicle navigation system 205 can be operably coupled to the two-way communications unit 201 such that the two-way communications unit 201 can make use of information as available to and provided by the vehicle navigation system 205. Also optionally a map memory 206 may be operably coupled to the vehicle navigation system 205. Such map information, when available, may also be available to the two-way communications unit 201 to facilitate one or more processes as described below. Also, various vehicle sensors 207 as provided with the vehicle can be coupled to the two-way communications unit 201. For example, the vehicle speedometer and odometer could optionally be coupled to the two-way communications unit 201 such that the information provided by these sensors could be used by the two-way communications unit 201 to practice various embodiments as taught below.

These various components are each well understood in the art, including two-way communications units that include logic capable of compatibly executing the processes taught below. Therefor, for the sake of brevity, additional description of these individual components need not and will not be provided here.

Referring now to FIG. 3, a basic process in accordance with one embodiment of the invention begins with a determination 301 by the user platform 200 as to whether service compliant with the roadway information service is presently available. When true, the user platform 200 uses 304 the roadway information as provided by roadway information service transmitters in an ordinary and usual fashion. When the user platform 200 can detect 301 an absence of such service, however, the user platform 200 begins using 302 substitute roadway information and provides 303 notice to the driver of the vehicle regarding the present use of substitute roadway information and/or the present absence of roadway information service transmissions. Such substitution and/or notice continues until compliant transmissions indicating presence of roadway information service are again detected 301. The provision 303 of notice to the driver can include provision of textual information regarding the absence of received radio frequency transmissions and/or provision of an audible notice regarding the absence of received radio frequency transmissions. Other forms of notification can be utilized as appropriate to a given application.

Additional details regarding these general steps will now be provided.

Referring now to FIG. 4, in one embodiment for detecting 301A the absence of service, the user platform 200 detects 401 reception of a transmission that is compliant with the roadway information service and initiates 402 a count. This count effectively continues until subsequent reception of another compliant transmission and/or the count is otherwise terminated by the user platform 200. Consequently, with the count since a last received compliant transmission incrementing, the user platform 200 determines 403 from time to time (the periodicity for such determinations can be adjusted to suit a given application) whether the count has attained a predetermined value. When finally this predetermined value has been met, the user platform 200 detects 404 the absence of service and the process illustrated in FIG. 3 proceeds as described.

So configured, the user platform 200 effectively determines that services from the roadway information service are absent by observing that no transmissions compliant with that service have been received for a predetermined count. That count can correlate to any useful milestone, including realtime, platform time, and/or actual distance traversed by the vehicle as reported, for example, by appropriate vehicle sensors. Note that the trigger point corresponding to a full count can be static or dynamic. When dynamic, the trigger point can be either varied automatically or by a user. In either instance, the count may be varied to reflect the very different service environment that may exist between, for example, a busy urban environment (where compliant transmissions can be expected frequently) and a roadway that traverses a flat and featureless unpopulated terrain (where compliant transmissions can be expected less frequently).

Referring to FIG. 5, an alternative embodiment for detecting 301B an absence of service supports a vehicle wherein at least one of the vehicle sensors 207 comprises an image capture mechanism for capturing images at least along the roadway 103. With such image information available to the two-way communications unit 201 the user platform 200 can scan 501 the captured images for particular shapes, which shapes are ordinarily accompanied by transmissions from compliant roadway information service transmitters. Upon detecting 502 that a particular scanned image includes a shape, the user platform 200 determines 503 whether that scanned shape matches one or more known shapes 504 that ordinarily include co-transmission of roadway information service data. In this example, the stored shapes include various roadway signs such as yield signs (shape 1), stop signs (shape 2), and information cautionary signs (shape N). When the user platform 200 detects 503 that a scanned shape indeed matches a stored reference shape 504 the user platform 200 then determines 505 whether a compliant transmission has also been received. When such an image has been detected 503 and no such compliant transmission has been similarly detected 505, the process then detects 506 an absence of roadway information service transmissions and the process concludes 507 and returns to the overall process described earlier.

So configured, the user platform can more directly ascertain the absence of roadway information service transmissions by specifically noting the absence of such transmissions in a situation where such a transmission would otherwise be expected. This approach can be used alone or in conjunction with the count-based approach disclosed above with respect to FIG. 4.

Again presuming the availability of an image scanner, other alternative and/or additional mechanisms for detecting a situation where compliant transmissions would ordinarily be expected will be described with reference to FIG. 6. In FIG. 6, for example, a roadway sign 601 fits on a signpost 602. As disclosed with reference to FIG. 5, the user platform 200 can scan for the shape of the sign 601 itself In addition, or in the alternative, indicia such as a particular bar code 603 can be included (in this example, on the signpost 602) which indicia 603 can be scanned and decoded by the user platform 200. Such an indicia can specifically confirm that the user platform 200 should presently be receiving a radio transmission that is compliant with the roadway information service. Knowing this, the user platform 200 can readily detect an absence of the roadway information service when such a transmission is absent under these circumstances.

As another alternative or addition, a light source 604 can be provided having a predetermined frequency or frequencies of illumination and/or a flashing signal pattern. Such a light source 604 can again be sensed by the user platform 200 to detect an area where a roadway information service transmission should be available. And again, by knowing that such a transmission should be presently available and by determining its absence, the user platform 200 can detect the absence of the roadway information service.

There are other ways in which the user platform 200 can detect the absence of radio frequency transmissions that are compliant with the roadway information service. Pursuant to one embodiment, the user input 204 for the user platform 200 can include an input mechanism that a user of the vehicle can assert to specifically inform the user platform 200 of the absence of such transmissions. For example, the user, upon observing a sign that informs travelers of the temporary or permanent absence of the roadway information service from a particular area can assert a button at the user input 204 to so inform the user platform 200.

Pursuant to another embodiment, the user platform 200 can have information stored in memory 202 that identifies geographic areas that are known to not contain radio frequency transmissions that are compliant with the roadway information service (this can include areas that are wholly or only partially devoid of such transmissions). By comparing this stored information with present location information as provided by the onboard vehicle navigation system 205, the user platform 200 can conclude when the vehicle has attained a particular position where absence of the service is likely and thereby detect the absence of the roadway information service.

Pursuant to another embodiment and with reference to FIG. 1, beacon transmitters 106 can be established at one or more boundaries of a geographic area 102 that does not support the roadway information service to notify a user 107 that the area the user is about to enter does not include such transmissions. Upon receiving such a beacon transmission, the user platform 200 can thereby detect the absence of received radio frequency transmissions that are compliant with the roadway information service.

Dedicated short-range communications for roadway information are not intended to exclude vehicle-to-vehicle communications. Vehicles will communicate between themselves to exchange various items of information including safety-related data such as brake applications, hazard light activation, rollover detection, and so forth. To the extent that a particular user relies upon the availability of such information, however, and to the extent that a given vehicle does not have such compatible capabilities, it can be appropriate or necessary to advise the user that the other vehicle is without such service capability. In this instance, and with reference again to FIG. 3, detecting service 301 can include detecting an absence of received radio frequency transmissions from a second vehicle that are compliant with the roadway information service. This detecting 301 step can include detecting a visible indicator on the second vehicle, such as a bar code or other symbol that identifies a vehicle as being without the service in question. In one embodiment, such a visible indicator would be positioned on one or both licence plates of the vehicle or other known and generally standard location. Pursuant to another embodiment, the service capable vehicle could probe the second vehicle with a radio frequency transmission that is compliant with the roadway information service to query the second vehicle's capabilities in this regard. Upon receiving no response, the first vehicle could thereby detect and affirm the non-service capabilities of the second vehicle.

In any of these cases, an appropriate notice could then be provided on the user interface 203 to alert the user to the presence of the service-impaired vehicle.

In yet another embodiment, and with reference to FIG. 1, a user 107 can receive a vehicle-to-vehicle radio frequency transmission that is compliant with the roadway information service from a vehicle 108 that is traveling from the geographic area 102 that does not include radio frequency transmissions that are compliant with the service. This message can include a notice regarding the absence of such service along with, for example, information regarding the time or location when the vehicle 108 first detected the absence of such transmissions. This information, upon being extracted by the first user 107, can then be used to detect at least an impending absence of received radio frequency transmissions that are compliant with the roadway information service. Such a vehicle-to-vehicle exchange may occur at the initial instance of the notifying vehicle 108 or may be initiated by transmission of a request for such information from the first vehicle 107.

Once the user platform 200 has detected the absence of roadway information transmissions, there are various ways in which the user platform 200 can use substitute roadway information. In one embodiment, the user platform 200 can access previously stored information that corresponds to the intended journey path through the area that is not presently serviced by radio frequency transmissions that are compliant with the roadway information service. Such information, for example, could be stored in the memory 202 of the user platform 200. Such information can be obtained from some secondary source or may represent a historical database for the vehicle itself (for example, if the user has traversed the area in question in the past, data gathered during such a journey may have been retained and is now available for use when again traversing this area without benefit of realtime roadway transmissions).

As another alternative and/or embodiment, a user could obtain such previously stored information from another vehicle (for example, the oppositely traveling vehicle 108 in FIG. 1 could transmit recently observed information as gathered through sensors or other input means when traveling the roadway 103 through the geographic area 102 not having the roadway information service). Such transmissions could be picked up by an incoming vehicle 107 to thereby make this information available for use by that vehicle 107 as substitute information when traveling the roadway 103 through the geographic area 102 in question. Such a downloading would, in most instances, follow a specific request from the incoming vehicle 107 for such information.

As another alternative and/or embodiment, beacon transmitters 106 can be placed proximal to an entry point for the geographic area 102 not having service support. These beacon transmitters 106 can constitute an information source to provide the user platform 200 with substitute information for use when traversing the geographic area 102 in question.

As yet another approach, the vehicle sensors 207 can, to some extent and under some circumstances, provide some information that can substitute, to some degree, for missing roadway information service transmissions. In general, such sensor information will typically be of greater value in this regard when they can be used in conjunction with other information. By yet another alternative and/or embodiment, the vehicle navigation system 205 (and map information 206 if available) can be used to provide estimates regarding at least some items of roadway information. To the extent that the user platform 200 can acquire information regarding, for example, sharp curves in the roadway 103, this information, when combined with the onboard navigation data and/or vehicle sensor information can be utilized to provide in-vehicle signage that appears similar or identical to in-vehicle signage as would otherwise be supported by the roadway information service.

With reference to FIG. 9, yet another embodiment for providing substitute roadway information will be described. In this embodiment, the terrestrial vehicle has a second user platform 900. This second user platform 900 includes at least a 1-way communications unit 901, a memory 902, a vehicle navigation system 903 and a map memory 904. The memory 902 includes roadway information for the second geographic zone 102 and this roadway information is correlated to location information (for example, a specific sharp curve correlates with specific longitude and latitude co-ordinates). The vehicle navigation system 903 and corresponding map memory 904 can be based upon global positioning satellite data, dead reckoning data, a combination thereof, or any other system that will allow relatively real-time ascertainment of present location of the terrestrial vehicle.

So configured, the vehicle navigation system 903 provides information to the communication unit 901 regarding the present location of the vehicle. The communication unit 901 utilizes this location information to probe the memory 902 for any corresponding roadway information. When roadway information does correspond to the present location of the vehicle, that roadway information is then returned to the communication unit 901. The communication unit 901 then transmits a very short-range radio frequency signal 906 that is compatible with the roadway service system such that the first user platform 200 will receive the transmission. The transmission 906 can be very short range because the signal only needs to propagate a few meters at most, and often less than a meter. When operating in this mode, if desired, the primary user platform 200 need not even necessarily be aware that substitute information is being used rather than real-time transmissions from roadway transmitters. In the alternative, the primary user platform 200 can be aware of the circumstances (for example, in one embodiment, the transmissions from the secondary user platform 900 can include a co-transmitted signal or code that marks the information as being locally generated and hence a substitute).

The secondary user platform 900 can be temporarily installed near, for example, the border to the second geographic zone 102. In the alternative, the platform 900 can be installed virtually anywhere including within the second geographic zone 102. In one embodiment the platform 900 would be provided to the vehicle user pursuant to a rental agreement. Once the user had traversed the second geographic zone 102, the platform 900 would then be returned at an appropriate return station. Presuming this sort of arrangement, the communication unit 901 in the secondary user platform 900 could readily be a one-way unit and serve adequately.

In the alternative, this second user platform 900 could be permanently installed in the user's vehicle. In this event, the communication unit 901 would likely benefit from being a two-way platform to facilitate, for example, downloading roadway information to its memory 902.

Instead of transmitting 906 roadway information wirelessly, since the secondary user platform 900 is co-located with the first user platform 200, a physical data tether 907, such as an optical conduit or electrical signal conduit, could be used to physically interconnect the first and second user platforms 200 and 900 to allow provision of substitute roadway information to the first user platform 200.

With reference to FIG. 1, it has been mentioned earlier that a geographic area 102 may temporarily be without roadway information service transmissions due to circumstances that place roadway transmitters 109 out of operation. Under such circumstances, some transmitters 110 may nevertheless continue to operate. When such occasional compliant transmissions can be received by the user platform 200, these reception events can be used to interpolate and extrapolate at least part of the substitute roadway information to enhance accuracy.

With reference to FIG. 7, the provision 303 of notice to the driver includes displaying 701 a notice of service absence to the driver. The user platform 200 then displays 702 the substitute information as available and applicable as mentioned above. Such substitute information, of course, will not ordinarily have the benefit of realtime relevancy as compared to transmissions within an operable roadway information service system. Under some circumstances, the user platform 200 can detect 703 a predetermined event and in response thereto remove 704 the display or provision of at least some substitute information to the user prior to concluding 705 and returning to the main process described above. For example, to determine 703 a particularly telling event, the user platform 200 can monitor the passage of time. When sufficient time in general, or when a specific amount of time as has been previously correlated to one or more given items of substitute information has expired, that expiration can constitute the predetermined event. As another example, the passage of a particular actual distance, again either in general or as a specific amount correlated to specific information can serve as the predetermined event. In this way, substitute information that may be inaccurate (due, in these examples to time or distance) can be purged from use to thereby minimize misleading the user with incorrect information.

With reference to FIG. 8, the user interface 203 can include one or more display areas (in this embodiment, a single display area has been depicted). In this embodiment, a common display provides information to the user regarding both at least one vehicle sensor 207 and roadway information as obtained from radio frequency transmissions that are compliant with the roadway information service. For example, vehicle sensors (in this case, the speedometer) indicate that the vehicle is traveling at fifty-three miles per hour, and this information 803 is displayed on the common display. The user platform 200 has meanwhile received transmissions from the roadway information service indicating that the present speed limit on the roadway 103 is fifty-five miles per hour, and this information 802 is displayed on the common display as well. Other information can be displayed as well. For example, appropriate signage 801 can be displayed on the common display to reflect signage information as received via the roadway information service.

So configured, this common display can also serve to provide notice regarding the absence of radio frequency transmissions that are compliant with the roadway information service. For example, when the roadway information service constitutes a DSRC service, a notation such as "No DSRC service" 804 can be provided on the common display. Pursuant to the embodiments described above, substitute roadway information can also be displayed on the common display. Typically, such substitute information can be displayed in exactly the same way as corresponding roadway service information transmissions themselves. If desired, additional indicia can be provided to alert the user that substitute information is being displayed 805.

Through these various embodiments, singly and in various combinations, a vehicle equipped with two-way roadway information service capability can detect when such services are unavailable (both with respect to roadway attributes and roadway facilities and with respect to other vehicles) and take automatic action to both notify the driver of such circumstances and to obtain and use substitute information, to an extent possible or appropriate, to ameliorate to at least some extent the absence of such information through ordinary means of conveyance.

While there have been illustrated and described particular embodiments of the present invention, it will be appreciate that numerous changes and modifications will occur to those skilled in the art, and it is intended in the appended claims to cover all those changes and modifications which fall within the true spirit and scope of the present invention.

What is claimed is:

1. A method comprising:

at a terrestrial vehicle:

detecting an absence of received radio frequency transmissions that are compliant with a first roadway information service;

in response to detecting an absence of received radio frequency transmissions that are compliant with the first roadway information service, automatically using substitute roadway information; and automatically providing notice to at least a driver of the terrestrial vehicle regarding at least one of:

the absence of received radio frequency transmissions; and the automatic use of substitute roadway information.

2. The method of claim 1 wherein the step of detecting comprises:

receiving a beacon radio frequency transmission that is compliant with the first roadway information service;

extracting a message from the beacon radio frequency transmission comprising a notice regarding at least an impending absence of received radio frequency transmissions that are compliant with the first roadway information service.

3. The method of claim 1 wherein the step of detecting comprises:

receiving a radio frequency transmission that is compliant with the first roadway information service;

in response to receiving the radio frequency transmission that is compliant with the first roadway information service initiating a count;

detecting the absence of received radio frequency transmissions that are compliant with the first roadway information service when the count attains at least a predetermined value before a subsequent reception of another radio frequency transmission that is compliant with the first roadway information service.

4. The method of claim 1 wherein the step of detecting comprises:

detecting a visual image which visual image should ordinarily be accompanied by reception of a radio frequency transmission that is compliant with the first roadway information service;

detecting the absence of received radio frequency transmissions that are compliant with the first roadway information service when reception of a radio frequency transmission that is compliant with the first roadway information service does not occur within a predetermined period of time subsequent to detecting the visual image.

5. The method of claim 4 wherein detecting a visual image comprises detecting at least one predetermined shape.

6. The method of claim 5 wherein detecting at least one predetermined shape comprises detecting at least one predetermined shape from amongst a plurality of predetermined shapes.

7. The method of claim 4 wherein detecting a visual image comprises detecting a bar code.

8. The method of claim 4 wherein detecting a visual image comprises detecting a light source having at least one predetermined frequency.

9. The method of claim 1 wherein the step of detecting comprises sensing that a user of the vehicle has asserted a predetermined input mechanism.

10. The method of claim 1 wherein the vehicle has an on-board navigation system and wherein the step of detecting comprises automatically interacting with the on-board navigation system to identify that the vehicle has attained a particular position with respect to a geographic area which geographic area is known to not contain radio frequency transmissions of at least a first type that are compliant with the first roadway information service.

11. The method of claim 1 wherein the step of detecting comprises:

receiving a vehicle-to-vehicle radio frequency transmission that is compliant with the first roadway information service;

extracting a message from the vehicle-to-vehicle radio frequency transmission comprising a notice regarding at least an impending absence of received radio frequency transmissions that are compliant with the first roadway information service.

12. The method of claim 1 wherein the step of automatically using substitute roadway information comprises accessing previously stored information that corresponds to a journey within an area that is at least not presently fully serviced by radio frequency transmissions that are compliant with the first roadway information service.

13. The method of claim 12 wherein the step of accessing previously stored information comprises receiving at least a part of the previously stored information from a second vehicle.

14. The method of claim 13 wherein the step of receiving at least a part of the previously stored information from a second vehicle comprises transmitting a request to the second vehicle for the information.

15. The method of claim 12 wherein the step of accessing previously stored information comprises accessing a historical database in the vehicle.

16. The method of claim 1 wherein the step of automatically using substitute roadway information comprises receiving at least one radio frequency transmission from at least one other information service.

17. The method of claim 1 wherein the step of automatically using substitute roadway information comprises processing signals received from on-board sensors on the vehicle.

18. The method of claim 1 wherein the vehicle has an on-board navigation system and stored map information regarding a geographic area that corresponds to an area where an absence of radio frequency transmissions that are compliant with the first roadway information service has been detected, and wherein the step of automatically using substitute roadway information comprises using the stored map information and the on-board navigation system to provide estimates regarding at least some items of roadway information.

19. The method of claim 1 wherein the step of automatically using substitute roadway information comprises using information received pursuant to reception of some radio frequency transmissions that are compliant with the first roadway information service to interpolate at least part of the substitute roadway information.

20. The method of claim 1 wherein the step of automatically using substitute roadway information comprises receiving at least one radio frequency transmission that is compliant with the first roadway information service, which at least one radio frequency transmission is sourced from the terrestrial vehicle.

21. The method of claim 20 wherein the step of receiving at least one radio frequency transmission includes the step of receiving at least one very short range radio frequency transmission.

22. The method of claim 1 wherein the step of automatically using substitute roadway information comprises the steps of:

determining a present geographic location of the terrestrial vehicle;

accessing a memory containing roadway information;

identifying at least one item of roadway information that correlates with the present geographic location of the terrestrial vehicle;

transmitting the at least one item of roadway information using a very short range radio frequency transmission that is compatible with the first roadway information service;

receiving the at least one item of roadway information and using the at least one item of roadway information as substitute roadway information.

23. The method of claim 1 wherein the step of automatically providing notice includes providing previously received roadway information to the user.

24. The method of claim 23 wherein providing previously received roadway information to the user includes persisting in displaying at least one item of previously received information for at least one of:

a predetermined period of time; and a predetermined traveled distance.

25. The method of claim 1 wherein the step of automatically providing notice includes providing a textual notice regarding the absence of received radio frequency transmissions.

26. The method of claim 1 wherein the step of automatically providing notice includes providing an audible notice regarding the absence of received radio frequency transmissions.

27. The method of claim 1 wherein the vehicle includes at least one sensor and wherein a common display is used to provide information to a user of the vehicle regarding both the at least one sensor and roadway information as obtained from radio frequency transmissions that are compliant with the first roadway information service, wherein the step of automatically providing notice includes providing the notice on the common display.

28. The method of claim 1 wherein detecting an absence of received radio frequency transmissions that are compliant with a first roadway information service comprises detecting an absence of the received radio frequency transmissions from a second vehicle.

29. The method of claim 28 wherein detecting an absence of the received radio frequency transmissions from the second vehicle includes detecting a visible indicator on the second vehicle.

30. The method of claim 29 wherein detecting a visible indicator on the second vehicle includes detecting a visible indicator on a license plate of the second vehicle.

31. The method of claim 28 wherein detecting an absence of the received radio frequency transmissions from the second vehicle includes transmitting to the second vehicle a radio frequency transmission that is compliant with the first roadway information service.

32. An apparatus for use in a terrestrial vehicle comprising:

detection means for detecting an absence of received radio frequency transmissions that are compliant with a first roadway information service;

information means responsive to the detection means for automatically providing substitute roadway information when roadway information is not available from the first roadway information service;

notification means operably coupled to at least one of the detection means and the information means for providing notice to at least a driver of the terrestrial vehicle regarding at least one of the absence of received radio frequency transmissions and the automatic use of substitute roadway information.

33. The apparatus of claim 32 wherein the detection means includes counter means for determining that a radio frequency transmission that is compliant with the first roadway information service has not been received for at least a predetermined count.

34. The apparatus of claim 32 wherein the detection means includes scanning means for scanning visual images along a roadway.

35. The apparatus of claim 34 wherein the detection means further includes means for identifying a scanned visual image as being an image that should be accompanied by reception of a radio frequency transmission that is compliant with the first roadway information service.

36. The apparatus of claim 32 and further including navigation means for determining a present location of the terrestrial vehicle, wherein the detection means includes means for correlating the present location of the terrestrial vehicle with previously stored information regarding known areas that have an absence of received radio frequency transmissions that are compliant with the first roadway information service.

37. The apparatus of claim 36 and further including memory means for storing at least historical roadway information, wherein the previously stored information is based at least in part on the historical roadway information.

38. The apparatus of claim 32 and further comprising display means for displaying at least part of the substitute roadway information.

39. The apparatus of claim 38 wherein the terrestrial vehicle includes sensors and wherein the display means further functions to display at least some information derived from at least one of the sensors.

40. The apparatus of claim 38 wherein the display means further functions to indicate to a user of the terrestrial vehicle that substitute information is being displayed when displaying at least part of the substitute roadway information.

* * * * *